US008191288B2

(12) United States Patent
Weagley et al.

(10) Patent No.: US 8,191,288 B2
(45) Date of Patent: Jun. 5, 2012

(54) REVERSIBLE SNOW PUSHER AND COUPLER

(75) Inventors: Michael P. Weagley, Rush, NY (US); Michael J. Guggino, Bloomfield, NY (US); James Maier, Rochester, NY (US)

(73) Assignee: Pro-Tech Manufacturing and Distribution, Inc., Rochester, NY (US)

( * ) Notice: Subject to any disclaimer, the term of this patent is extended or adjusted under 35 U.S.C. 154(b) by 155 days.

(21) Appl. No.: 11/556,106

(22) Filed: Nov. 2, 2006

(65) Prior Publication Data

US 2007/0107271 A1 May 17, 2007

Related U.S. Application Data

(60) Provisional application No. 60/732,944, filed on Nov. 3, 2005.

(51) Int. Cl.

| | |
|---|---|
| ***E01H 5/06*** | (2006.01) |
| ***E01H 5/04*** | (2006.01) |
| ***E02F 3/96*** | (2006.01) |
| ***A01B 15/00*** | (2006.01) |

(52) U.S. Cl. ..... 37/267; 37/231; 37/468; 172/702

(58) Field of Classification Search ..... 37/263, 37/264, 266, 267, 268, 231, 468; 172/272, 172/273, 811, 816, 701.1, 701.2, 702, 703, 172/704, 817

See application file for complete search history.

(56) References Cited

U.S. PATENT DOCUMENTS

| | | | | |
|---|---|---|---|---|
| 520,479 | A | | 5/1894 | Bunnell |
| 634,578 | A | | 10/1899 | Kaucher |
| 637,712 | A | | 11/1899 | Damerell |
| 842,704 | A | | 1/1907 | Robins |
| 1,373,799 | A | | 4/1921 | Conley |
| 1,528,141 | A | * | 3/1925 | Arndt ..... 172/170 |
| 1,581,414 | A | | 4/1926 | Young |
| 2,061,585 | A | | 11/1936 | Meyer |
| 2,078,636 | A | | 4/1937 | Kuchar |
| 2,092,990 | A | | 9/1937 | Southwick |
| 2,320,723 | A | | 6/1943 | Gaylord |
| 2,393,432 | A | | 1/1946 | Turner |

(Continued)

FOREIGN PATENT DOCUMENTS

| | | |
|---|---|---|
| CA | 2126408 | 3/2000 |

(Continued)

OTHER PUBLICATIONS

FFC; Lawn & Landscape—Snow—Sep. 1998, p. 59.

(Continued)

*Primary Examiner* — Thomas Will

*Assistant Examiner* — Abigail A Risic

(74) *Attorney, Agent, or Firm* — Duane C. Basch; Basch & Nickerson LLP

(57) ABSTRACT

Disclosed herein are various aspects of an improved snow or material pushers for use with loaders, backhoes, agricultural and larger home and garden tractors and the like for moving snow or other materials on generally flat areas such as parking lots, driveways, feed lots, runways, and loading areas. The improvements include, among others, a reversible design, extended side plates and/or wear shoes as well as improved scraping edge configurations so as to provide added functionality and versatility to pushers. As described the various features may be employed alone or in combination to provide the capability for snow and ice removal while minimizing the potential for damage to surfaces and objects thereon.

16 Claims, 12 Drawing Sheets

U.S. PATENT DOCUMENTS 2,445,140 A 7/1948 Hanington
2,515,384 A 7/1950 Von Carnop
2,552,426 A 5/1951 Hedley
2,577,977 A 12/1951 Nelson
2,723,471 A 11/1955 Trundle
2,732,638 A 1/1956 Leufvenius
2,763,944 A 9/1956 Magee
2,841,897 A 7/1958 Duke
2,882,620 A 4/1959 MacDonald
3,130,843 A * 4/1964 Kelly ..... 37/444
3,149,679 A 9/1964 Johnson et al.
3,189,203 A * 6/1965 Brocklebank et al. ..... 414/694
3,312,002 A 4/1967 Benetti
3,391,478 A 7/1968 Astill
3,398,472 A 8/1968 Leijon
3,413,738 A 12/1968 Goldberg
3,456,456 A 7/1969 Mayer
3,465,456 A 9/1969 Mever
3,466,766 A 9/1969 Kahlbacher
3,477,149 A 11/1969 Wagner
3,547,203 A * 12/1970 Jackoboice ..... 172/500
3,557,850 A 1/1971 Owens et al.
3,583,084 A 6/1971 Farrell
3,604,517 A 9/1971 Clifford
3,665,622 A 5/1972 Lamb
3,755,933 A 9/1973 Lowrey
3,793,752 A 2/1974 Snyder
3,845,870 A 11/1974 Balderson et al.
3,941,262 A * 3/1976 Moser et al. ..... 414/722
4,004,695 A 1/1977 Hockensmith et al.
4,019,268 A 4/1977 Waterman
4,027,409 A 6/1977 Stepe
4,071,155 A 1/1978 Hart et al.
4,094,348 A 6/1978 Wolf
4,220,210 A 9/1980 Degelman
4,249,323 A 2/1981 Mathis
4,255,878 A 3/1981 Mahler et al.
4,275,514 A 6/1981 Maura
4,288,932 A 9/1981 Küpper
4,306,362 A 12/1981 Waterman
4,356,645 A 11/1982 Hine
4,439,088 A 3/1984 Summa
4,446,639 A 5/1984 Bohn
4,478,289 A 10/1984 Enix
4,531,713 A 7/1985 Balboni
4,552,250 A 11/1985 Luebrecht
4,570,366 A 2/1986 Yost
4,577,423 A * 3/1986 Hahn ..... 37/455
4,597,205 A 7/1986 Guest
4,686,802 A 8/1987 O'Driscoll
4,704,811 A 11/1987 Jefferson
4,707,936 A 11/1987 Steinhoff
4,723,609 A 2/1988 Curtis
4,741,116 A 5/1988 Engle
4,779,363 A 10/1988 Boutrais et al.
4,819,349 A 4/1989 Mensch
4,819,955 A 4/1989 Cobb
4,899,472 A 2/1990 Winter
4,936,392 A 6/1990 Kitchin
4,962,600 A 10/1990 Zellaha
5,014,451 A 5/1991 Bandzul
5,046,271 A 9/1991 Daniels
5,050,322 A 9/1991 Burkard
5,109,618 A 5/1992 Grubler et al.
5,114,296 A 5/1992 Badder
5,121,562 A 6/1992 Feller
5,129,169 A 7/1992 Aubichon
5,136,795 A 8/1992 Rosenberg
5,285,588 A 2/1994 Niemela
5,297,351 A 3/1994 Cote
5,338,148 A 8/1994 Ronnblom
5,392,538 A 2/1995 Geerligs
D358,401 S 5/1995 Devaney
5,411,102 A 5/1995 Nickels
5,437,113 A 8/1995 Jones
5,471,770 A 12/1995 Ferreira
5,473,541 A 12/1995 Ishino et al.
5,477,930 A 12/1995 Degelman et al.
5,484,250 A * 1/1996 Gilmore et al. ..... 414/723
5,535,830 A 7/1996 Matsushita et al.
5,568,694 A 10/1996 Capra
D377,653 S 1/1997 Matisz et al.
5,595,007 A 1/1997 Biance
5,599,135 A 2/1997 Delaurenti
5,611,157 A 3/1997 Ferreira
D379,464 S 5/1997 Bruns
5,655,318 A 8/1997 Daniels
5,667,004 A 9/1997 Kroetsch
5,682,953 A 11/1997 Buysse
5,697,731 A 12/1997 Bonds
5,724,755 A 3/1998 Weagley
5,729,919 A 3/1998 DeBoer
5,743,032 A 4/1998 Vauhkonen
5,799,737 A 9/1998 Kamikawa et al.
5,815,957 A 10/1998 McKeown
5,819,444 A 10/1998 Desmarais
5,860,230 A 1/1999 Daniels
5,894,689 A 4/1999 Turk
5,899,007 A 5/1999 Niemela
5,938,399 A * 8/1999 Knutson ..... 414/722
6,049,927 A 4/2000 Thomas et al.
6,112,438 A 9/2000 Weagley et al.
6,134,813 A 10/2000 Vickers
6,269,556 B1 8/2001 Kallqvist
6,298,585 B1 10/2001 Boulet
6,314,666 B1 * 11/2001 Klemenhagen et al. ..... 37/267
6,347,465 B1 2/2002 Jensen
6,360,459 B1 * 3/2002 Brookhart et al. ..... 37/442
6,425,196 B1 7/2002 Weagley et al.
6,439,279 B1 8/2002 Underwood
6,470,604 B1 10/2002 Foster et al.
6,481,506 B2 11/2002 Okada et al.
6,526,678 B2 * 3/2003 Waddington, Jr. ..... 37/406
6,536,141 B2 3/2003 Kitchell
6,560,904 B2 5/2003 Guggino
D478,097 S 8/2003 Vennard et al.
6,612,050 B2 9/2003 Takeuchi
6,845,576 B2 1/2005 Vennard et al.
D511,173 S 11/2005 Fatemi
D511,174 S 11/2005 Fatemi
D512,443 S 12/2005 Fatemi
D519,128 S 4/2006 Vennard et al.
D519,129 S 4/2006 Vennard et al.
7,351,028 B2 * 4/2008 Potter et al. ..... 414/723
D570,377 S 6/2008 Evans et al.
7,412,787 B2 * 8/2008 Sutton et al. ..... 37/267
7,743,536 B2 6/2010 Evans
7,805,863 B2 10/2010 Vennard
2003/0101626 A1 6/2003 Johnson
2003/0221340 A1 * 12/2003 Ganswich ..... 37/466
2004/0250454 A1 * 12/2004 Jager ..... 37/266
2005/0097786 A1 5/2005 Vennard et al.
2005/0126051 A1 * 6/2005 Fatemi ..... 37/266
2006/0070759 A1 * 4/2006 Nesseth ..... 172/817
2007/0107272 A1 5/2007 Weagley et al.
2008/0235996 A1 10/2008 Evans et al.

FOREIGN PATENT DOCUMENTS

DE 8300983 6/1983
FR 2539438 7/1984
JP 7088642 4/1995
SE 503193 4/1996
SE 01115-0 5/2005
WO WO 9008234 7/1990
WO 9107345 5/1991
WO WO2006123982 11/2006

OTHER PUBLICATIONS

FFC; 4 webpages; www.ffcattachments.com; Nov. 29, 2000; FFC, 100 E. Lee Road; Box 122, Lee, IL 60530.

Daniels Box Plow; A Box Plow with a Steel Tip Edge; www.danielsplows.com; 1advertising page; Great Lakes & Northeast Blg Truck & Equipment Traders—Apr. 27, 2001; Issue #16.

An unofficial file history as of Jun. 23, 2009 for pending U.S. Appl. No. 11/556,116.

An unofficial Office Action issued Apr. 26, 2011 by the Canadian Intellectual Property Office for Canadian Patent Application 2566993 Filed Nov. 2, 2006, Published May 3, 2007, as 2566993 which corresponds to U.S. Appl. No. 11/556,106; Inventor: Michael P. Weagley et al.
FR2539438—An Abstract of French Patent FR2539438 issued July 20, 1984 (Application FR19840000510 Filed Jan. 13, 1984); Inventor Kueper, Walter; Applicant Kuper Gummi GMBH [DE].
Pro-Tech Welding & Fabrication, Inc., Industrial & Contractor Services Brochure; 4 pages.
Pro-Tech Snopushers Brochure; 4 pages.
Pro-Tech Foldout—FOP Model Brochure; C. 2001; WWW.SNOPUSHER.COM.
Degelman Brochure; 16 pages; Degelman Industries Ltd; WWW.DEGELMAN.COM.
An unofficial prosecution history as of Dec. 23, 2010 of Canadian patent application CA2566988 which corresponds to U.S. Appl. No. 11/556,116.
An unofficial prosecution history as of Dec. 23, 2010 of Canadian patent application CA2566993 which corresponds to U.S. Appl. No. 11/556,106.
An unofficial prosecution history between Jun. 23, 2009 and Dec. 23, 2010 for U.S. Appl. No. 11/556,116.
Blaw-Knox Asphalt Pavers leaflet; 1 page; c. 1996; Blaw-Knox Construction Equipment Corporation.
Blodgett, O., Design of Weldments; c. 1963 by The James F. Lincoln Arc Welding Foundation, Cleveland, Ohio; 64 pages.
Bonnell Push 'N-Plow brochure; 5 pages; Bonnell Industries Inc., 1385 Franklin Grove Rd., Dixon, IL 61021; Fax Date May 3, 2002.
Bonnell What's New 4 Webpages, 2001; bonnell.com; Bonnell Industries, Inc, advertising Push n. Plow snow plow.
Buffalo Truck Equipers, Inc. Snow Pushers Advertisement; Buffalo Truck Equipers, Inc., 740 Hinman Ave, Buffalo, NY 14207; 2 pages; Truck Trader Oct. 25-Nov. 1, 2000—Issue 44.
CAT D250E Articulated Truck brochure AEHO5029 (Mar. 1995); c. 1995 Caterpillar; 14 pages.
Communication enclosing Ronnbloom 1 page brochure; 3 Ronnbloom invoices dated Jan. 31, 1998.
CWS Excavator Attachments and Couplers brochure; 6 pages; CWS Industries Ltd., 19490-92 Ave, Surrey, BC CA V4N4G7; no. date available.
CWS Wheel Loader Attachments and Couplers; 10 pages; CWS Industries Ltd., 19490-92 Ave, Surrey, BC CA V4N4G7.
Degelman 40 years Brochure 1962-2002; 24 pages; Degelman product brochure 2002; Degelman Industries Ltd; 272 Industrial Dr. Regina, SAS, CA S4P 3B1; degelman.com.
Degelman Dozer Blades 3400 Series brochure, 92 pages, 1978-1980, Degelman Industries Ltd., PO Box 830, Regina, SAS, CA.
Degelman Dozer Blades 4400 Series brochure, 94 pages, 1978-1980, Degelman Industries Ltd., PO Box 830, Regina, SAS, CA.
Degelman Dozer Blades 4WD Series brochure, 95 pages, 1978-1980, Degelman Industries Ltd., PO Box 830, Regina, SAS, CA.
Degelman Dozer Blades brochure; 4 pages;Degelman Industries Ltd., PO Box 830, Regina, SAS, CA; Earliest publication date unknown, available approx. Jan. 1, 1980.
Fair Mfg Snow Removal Equipment; 3 webpages; web archive 2000.
First Place Pusher brochure 2 pages; May 2002; First Place Pusher, Route 68, Rutland MA 01543.
Henke Manufacturing Corporation; Montana Asphalt Topper Henke Model MAT; brochure 2 pages 1998;Henke Manufacturing Corporation, 3070 Wilson Street, Leaveworth, Kansas, 66048.
HL Machineries; Ma Revue de Machinerie Agricole, 1 pages advertisement; Oct. 2001; HL Machinerie, 7850 Boul. Parc Industriel, Ste-Gertrud (QC) CA G0X 2S0.
Hyundai HL720-3 Wheel Loader, brochure 12 pages; Jun. 1999; Hyundai Heavy Industries Co., Ltd,, Seoul, Korea.
Hyundai HL740-3 HL740TM-3 New Series, brochure 12 pages; Jul. 1998; Hyundai Heavy Industries Co., Ltd,, Seoul, Korea.
JP7088642_JP19930257525 Abstract and Machine Translation of JP7088642; Apr. 4, 1995; (JP application JP19930257525).
JRB Quick Couplers & Attachments brochure 4 pages; JRB Company, Inc.; 2444 Gilcrist Rd., Akron, OH 44305.
Ledex Avalanche Bury the Competition Advertisement 5 pages; 1998; Ledex Industries Corp, 307 Humberline Drive, Toronto, Ontario, CA.
Ledex Avalanche loader; Apr. 23, 2002;ledexindustries.com/avalanche/loader; 5 pages; Snow Plow Supply—Arctic Snow Plows; snowplowsupply.com/avalanche; pages; Avalanche loader, backhoe, Skid-steer.
Ledex Avalanche with Bobcat 763, 1 webpage, web.archive.org/web/20010409071050/www.ledexindustries.com/avalanche/skidsteer; 2001.
Mann Pin on Rakes brochure 4 pages; Mann Corporation, 15111 Smokey Point Blvd., Marysville,WA 98270.
Monroe Snow and Ice Control Brochure; 3 pages; Monroe Snow Removal Systems for Construction Machinery, 1051 W. 7th St., Monroe, WI 53566.
Orsolini Drawing; Orsolini Welding and Fabrication, 2006 W. Superior, Chicago, IL; Isometric Drawing of Rear End Plow dated Jan. 6, 1978.
Pro-Tech Fold Out Pusher FOP brochure 1 page c. 2001; Pro-Tech, 711 West Ave., Rochester, NY.
ProTech Material Handler Box; 1 page brochure; Protech Manufacturing and Distribution, 711 West Ave., Rochester, NY 14611; 1998.
RCS SnoPro Ads Specifications; 5 pages; RCS Sno-Pro, 1029 Lyell Ave., Rochester, NY.
RCS SnoPro Clear Path 4 Webpages; 2002; ClearPathProducts.com.
RCS SnoPro color advertisement, 1 page; RCS Manufacturing and Development, 1029 Lyell Ave., Rochester, NY.
RCS SnoPro Series advertisement, 3 webpages containing dates Oct. 13, 2003 and Feb. 27, 2004; rcssnopro.com.
RCS SnoProWinter Weather; 1 webpage; 2004; winterweatherservices.com.
Ronnblom Swedish Communication with translation and Drawing Sheet; No date available.
SnowPlow Supply 4 Webpages; Mar. 2001; snowplowsupply.com.
SNOWPRO, Cygnus Magazine Supplement 2_1998; 22 pages; Snow Pro Supplement, 1233 Janesville Ave., Fort Atkinson, WI 53538.
SNOWPRO, Magazine Supplement 1_1997; 28 pages; Snow Pro Supplement, 1233 Janesville Ave., Fort Atkinson, WI 53538.
SNOWPRO, Magazine Supplement 2_1997; 24 pages; Snow Pro Supplement, 1233 Janesville Ave., Fort Atkinson, WI 53538.
Tenco Machinery Ltd, engineers snow equipment, products, web pages; 4 pgs; c.1998; web.archive.org/web/20010906132217; download Apr. 4, 2007; Hansen invoice dated Dec. 7, 1999 sale of Tenco TC-272 14LM (1 pg); photo of snowblower on truck (1 page).
Tenco Snowblower TC-272 brochure specification sheet; 2 pages; c. 1994; Tenco Machinery (CDN) Ltd; C.P. 60, St-Valerien-de-Milton, Quebec, CA J0H 2B0;telephne 450-549-2411; website tenco.ca.
Tenco TC-272 Snowblower Manual 14292; operator's parts & maintenance manual & parts catalog; 1999; Les Machineries Tenco (CDN) ; 1318, Principale, St-Valerien-de-milton, Quebue, CA J0H 2B0; website tenco.ca; 70 pages.
Tink, Inc.; Hydraulic attachments for loaders and tractors brochure; 4th Edition; c. 1986 Tink, Inc.; 2361 Durham-Dayton Hwy., Durham, California.
Office action dated Dec. 28, 2011 for Canadian Patent Application 2566988 filed Nov. 2, 2006, published May 3, 2007, as 2566988; Inventor: Michael P. Weagley et al.; (Corresponding to U.S. Appl. No. 11/556,116).

* cited by examiner

REVERSIBLE SNOW PUSHER AND COUPLER

This application claims priority from U.S. Provisional Application 60/732,944, for a "Snow Pusher," filed Nov. 3, 2005 by Michael P. Weagley et al., which is also hereby incorporated by reference in its entirety.

The following disclosure is directed to aspects of an improved snow or material pusher for use with loaders, backhoes, agricultural and larger home and garden tractors and the like for moving snow or other materials on generally flat areas such as parking lots, driveways, feed lots, runways, and loading areas, for example.

BACKGROUND AND SUMMARY OF THE INVENTION

A "pusher" or "pushing apparatus," as described for example in U.S. Pat. No. 5,724,755 to Weagley (issued Mar. 3, 1998) or the folding material plow of U.S. Pat. No. 6,112,438, to Weagley et al. (issued Sep. 9, 2000), both hereby incorporated by reference in their entirety, generally include sides extending forward from a mold board or central blade to assure material being pushed (e.g., snow, liquids, debris, sludge, etc.) remains in front of the pusher, and is not directed to one or both sides as with conventional plows.

The following disclosure is directed to aspects and embodiments of an improved pusher design, including several aspects that can be employed on traditional pusher designs in order to improve the use and efficiency of such pushers. The disclosed aspects and embodiments, alone and in combination, improve the functionality, reliability, ease of use and/or safety of pushers.

In accordance with an aspect of the embodiments disclosed herein, there is provided a material pushing apparatus, comprising: an upstanding central blade including a first longitudinal edge and a second longitudinal edge along an opposite side of said blade, and left and right ends; a vertical side plate attached to and extending forward at a generally perpendicular angle from each of the ends of the central blade; a first cutting edge attached to the central blade along the first longitudinal edge; and a second cutting edge attached to the central blade along the second longitudinal edge.

In accordance with another aspect disclosed herein, there is provided a reversible coupler for use with a reversible implement, comprising: a first coupler portion suitable for attachment to a vehicle in a first orientation; and a second coupler portion suitable for attachment to the vehicle in a second orientation.

In accordance with another embodiment, there is disclosed a method of using a reversible pusher, comprising: connecting a vehicle to the pusher in a first orientation having a first cutting edge adjacent a surface upon which the pusher rests; advancing the pusher with the first cutting edge adjacent the surface; disconnecting the pusher from the vehicle; reconnecting the vehicle to the pusher in a second orientation having a second cutting edge adjacent the surface; and advancing the pusher with the second cutting edge adjacent the surface.

In accordance with a further aspect, there is provided an improved scraping edge for attachment along a longitudinal edge of a moldboard, comprising: a flexible base, removably attached to the moldboard, along a top portion of the base; a rigid cutting edge extending along and removably attached to said flexible base along a bottom portion of the base, wherein said flexible base flexes to allow the cutting edge to bypass immovable objects it contacts; and a tensioner to bias said flexible base into a partially flexed position.

In accordance with yet another aspect of the invention, there is provided a material pushing apparatus, comprising: an upstanding moldboard including a bottom longitudinal edge, and left and right ends; a vertical side plate attached to and extending forward at a generally perpendicular angle from each of said left and right ends of the moldboard; and a scraping edge attached to the moldboard along said bottom longitudinal edge, said scraping edge including, a flexible base, removably attached to the moldboard, along a top portion of the flexible base using at least one hold-down member; a rigid cutting edge extending along and removably attached to said flexible base along a bottom portion of the base, wherein said flexible base flexes to allow the cutting edge to bypass immovable objects it contacts; and a tensioner to bias said flexible base into a partially flexed position.

In accordance with a further aspect disclosed herein there is provided a material pusher, comprising: an upstanding central blade including a lower longitudinal edge and left and right ends; a vertical side plate extending forward at a right angle from each end of the central blade; and removable wear shoe attached along a bottom edge of each vertical side plate, wherein the removable wear shoe extends from a position adjacent a front edge of the vertical side plate to a position at least 6 inches beyond a rear surface of the moldboard so as to assure that a bottom surface of the wear shoe remains in complete contact with a surface on which the pusher is used.

In accordance with yet a further aspect of the following disclosure there is provided an extended wear shoe for use on a material pusher, comprising: a web for attachment to a side plate of the pusher; a generally horizontal lower surface for sliding contact with the ground, the lower surface transitioning to front and rear ramped surfaces on either end thereof; and a cap, permanently attached to the web and the upper end of the rear ramped surface thereof.

Disclosed in accordance with another embodiment is an improved scraping edge for attachment along a longitudinal edge of a pusher moldboard, comprising: a plurality of rigid sections; said sections being attached along the longitudinal edge using fasteners having a low yield strength and hardness such that one or more sections are dislodged from a normal operating position upon contact with an immovable object to thereby prevent damage to the object.

Also disclosed with respect to yet a further embodiment is a material pushing apparatus, comprising: an upstanding central blade including a lower longitudinal edge and left and right ends; a vertical side plate extending forward at a right angle from each end of the central blade; and a breakaway cutting edge, comprised of a plurality of rigid sections, attached to the central blade along the longitudinal edge, wherein at least one of the sections is dislodged from its normal operating position upon sufficient contact with an immovable object to prevent damage to the object.

In accordance with a further aspect disclosed herein there is provided a material moving apparatus, comprising: an upstanding moldboard including a bottom longitudinal edge, and left and right ends; a vertical side plate attached to and extending forward at a generally perpendicular angle from each of said left and right ends of the moldboard; and a scraping edge attached to the moldboard along said bottom longitudinal edge, said scraping edge including a rigid component and means for assuring that said rigid component yields upon coming in contact with an immovable object.

DETAILED DESCRIPTION

As used herein the figures are intended to be exemplary in nature, not limiting, and some or all aspects depicted may not be to scale. As will be further contemplated, various aspects of the disclosed embodiments have particular application to alternative snow removal and material moving technologies and while described in accordance with snow pushers and material pushing apparatus, are not intended to be limited to such embodiments. Accordingly, several of the aspects described herein may find particular use in plow, scraper, drag plow and similar applications in the same manner as described relative to snow or other material pushing embodiments.

Figure 1:
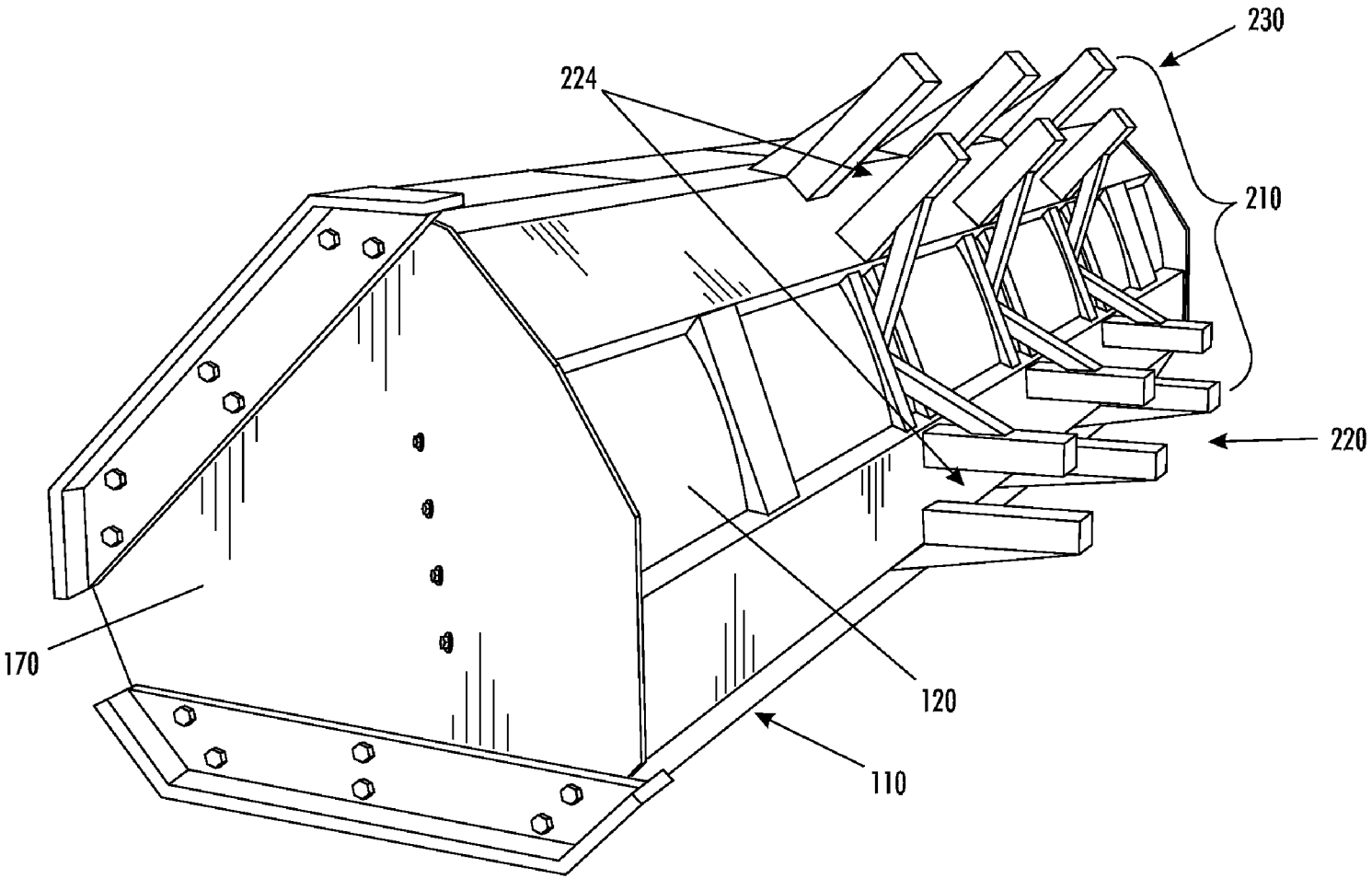
FIGS. 1-4 illustrate various features and aspects of a switchblade, reversible coupling pusher in accordance with one embodiment.
Figure 2:
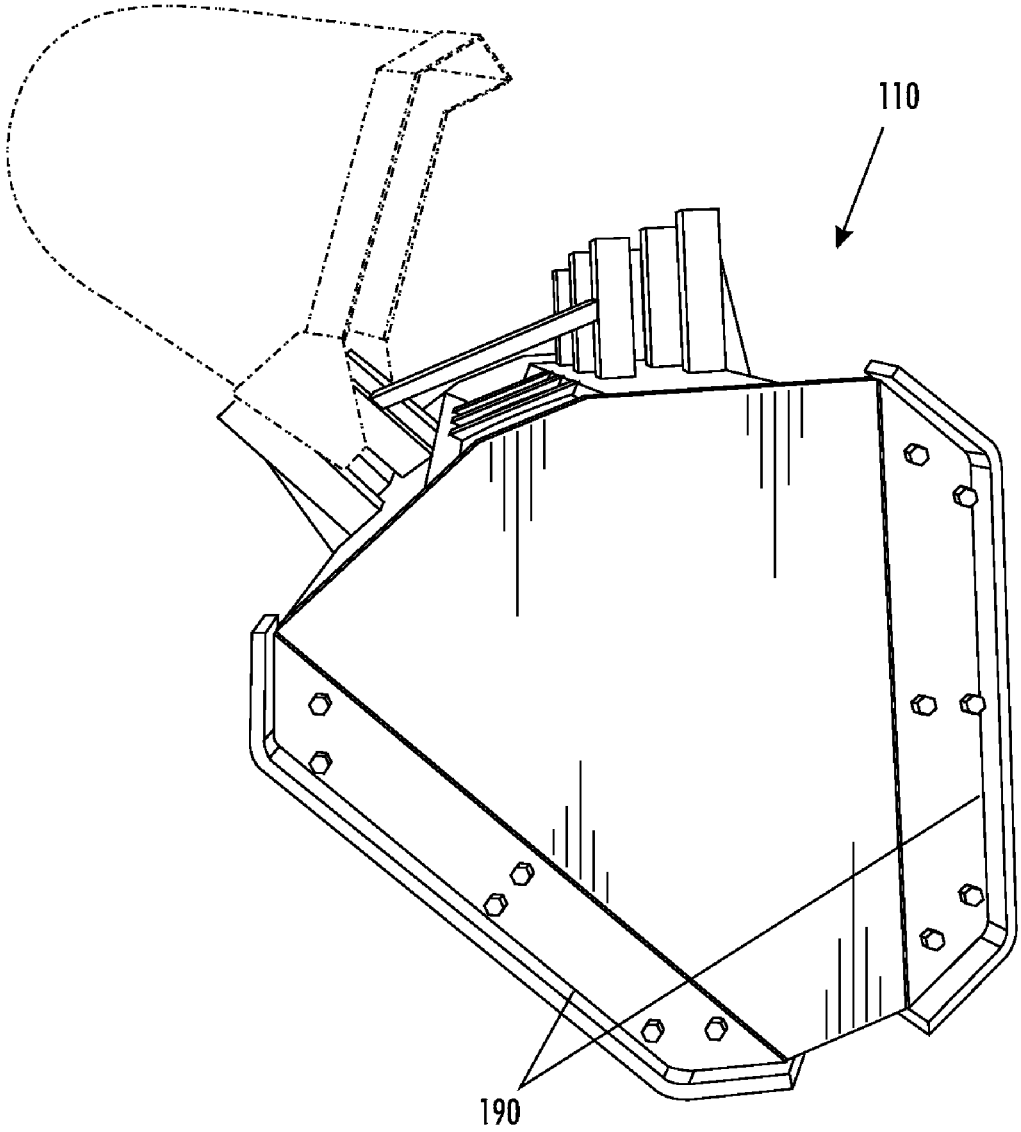
Figure 3:
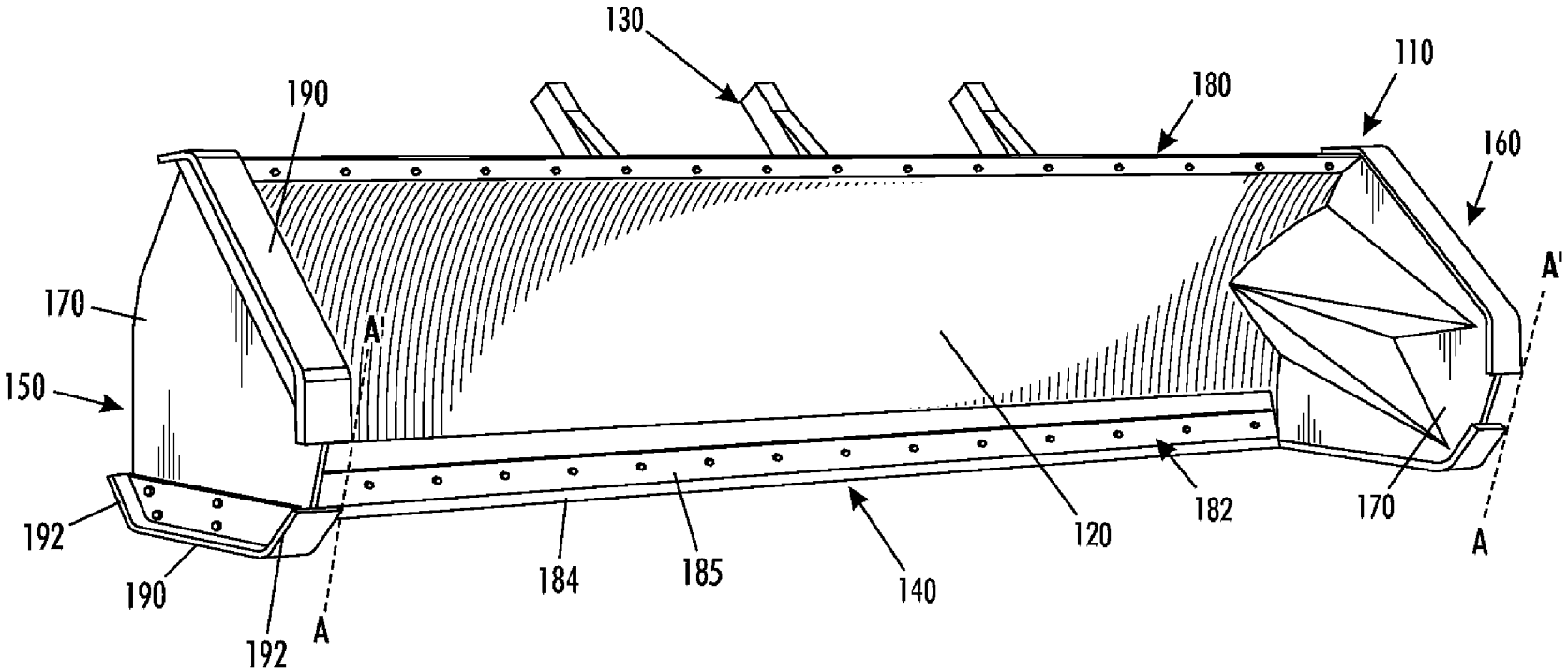
Figure 4:
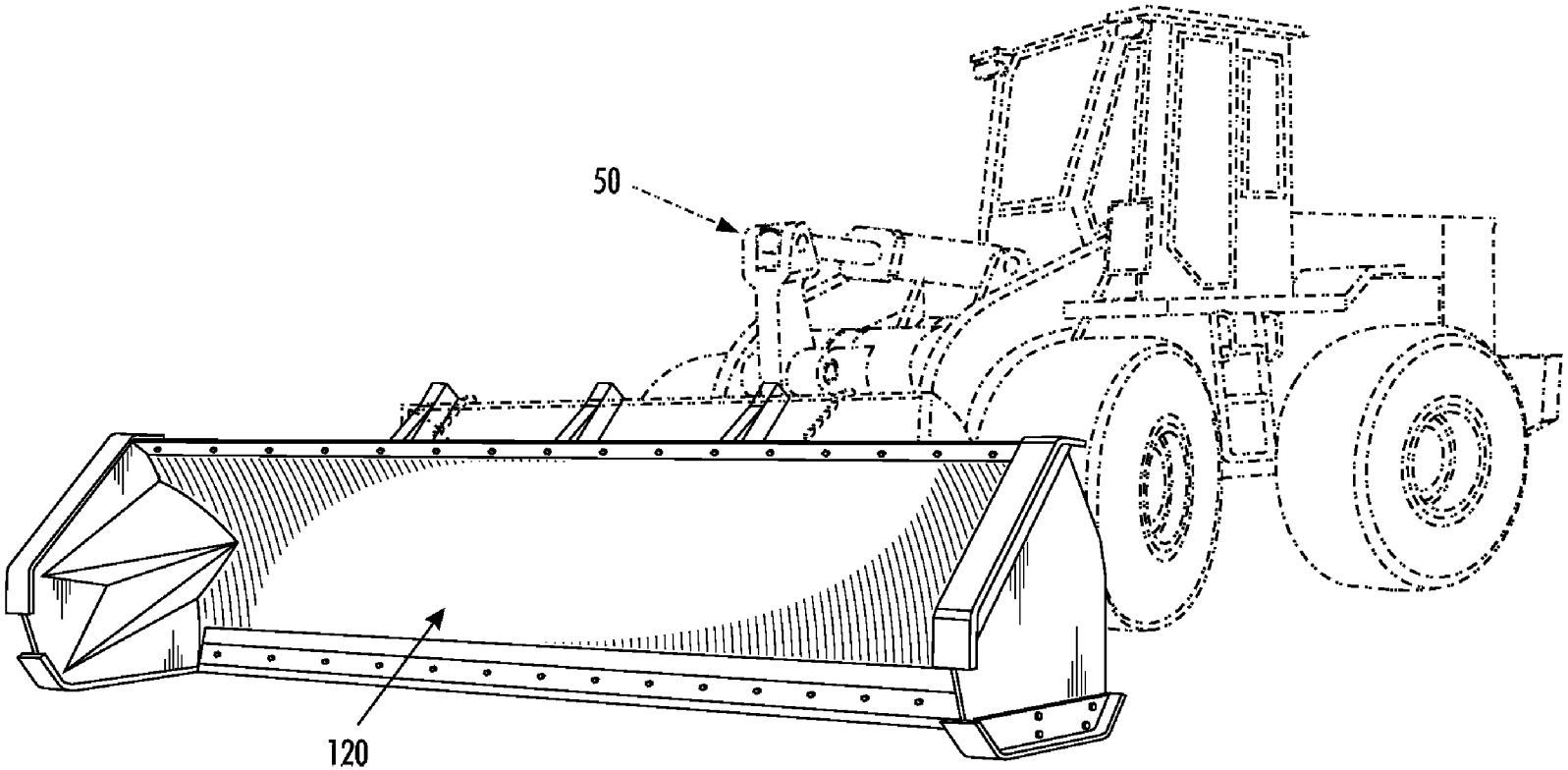

Referring first to FIGS. 1-5H, various aspects of a switchable/reversible orientation or Switchblade™ pusher configuration will be discussed in detail, along with a reversible coupling mechanism associated therewith. FIGS. 1 and 3, for example, illustrate a switchable orientation material pushing apparatus 110. The intent of such a device is to provide two different types of scraping edges (e.g., hard and/or flexible) in a single material pusher so that a user can accommodate many different material conditions. In particular, the apparatus is believed to find practical use in its ability to handle new-fallen snow as well as hard-packed and re-frozen snow and ice that accumulate in parking lots and other heavily traveled areas.

Referring specifically to FIGS. 1-3, Switchblade pusher 110 includes an upstanding central blade or moldboard 120 having a first longitudinal edge 130 and a second longitudinal edge 140 and left and right ends 150, 160, respectively. Also included is a vertical side plate 170 extending forward at a right angle from each of the ends 150, 160 of the central blade 120. A first cutting or scraping edge 180 is attached to the central blade or moldboard along the first longitudinal edge 130, and a second cutting or scraping edge 182 is attached to the central blade along the second longitudinal edge 140.

In one embodiment the Switchblade™ two-edged pusher has both a flexible polymer or rubber cutting edge 182 attached along a first longitudinal edge and a more rigid or steel cutting edge 180 along a second longitudinal edge. The flexible edge is perfect for wet, heavy snow conditions or jobsites where there are ground obstacles or imperfections in the surface being cleared. The steel edge 180 is ideal for hard packed snow conditions or jobsites that are flat with no ground obstacles. Alternatively, the steel edge 180 may be used on surfaces where some scraping and even removal of the top surface is desirable, for example, cleaning of animal barns and feedlots. Depending upon the situation the Switchblade pusher provides both types of edges on a single device.

One embodiment may include at least one flexible or rubber edge removably fastened to the central blade and extending along a longitudinal edge thereof. In FIG. 3, a flexible rubber edge is generally depicted as 184 where the edge is reversible (by switching top for bottom), and is held to the face of the moldboard 120 using an elongated steel plate(s) as a hold-down member 185. Moreover, it is contemplated that at least one cutting or scraping is removably fastened to the central blade along a longitudinal edge. As described above, at least one of the cutting edges comprises a rubber or flexible polymer edge 184 extending along and outward from one of the longitudinal edges of the central blade. As illustrated, such an edge is attached to the central blade 120 using a backing plate and bolts, and in some cases, the position of the edge may be adjusted upward or downward using slotted holes in the edge 184 through which the bolts are connected to nuts (not shown) behind the central blade.

It is further contemplated that one of the cutting edges of the reversible pushing apparatus may be a scraping edge 180 (see also 850 in FIG. 8), attached to the moldboard 120 along one longitudinal edge. The scraping edge 180 includes a rigid component and means for assuring that the rigid component yields upon coming in contact with an immovable object. In one embodiment, the scraping edge 180 may be a breakaway edge, wherein at least one of rigid components or sections is dislodged from its normal operating position upon sufficient contact with an immovable object to prevent damage to the object.

Figure 5A:
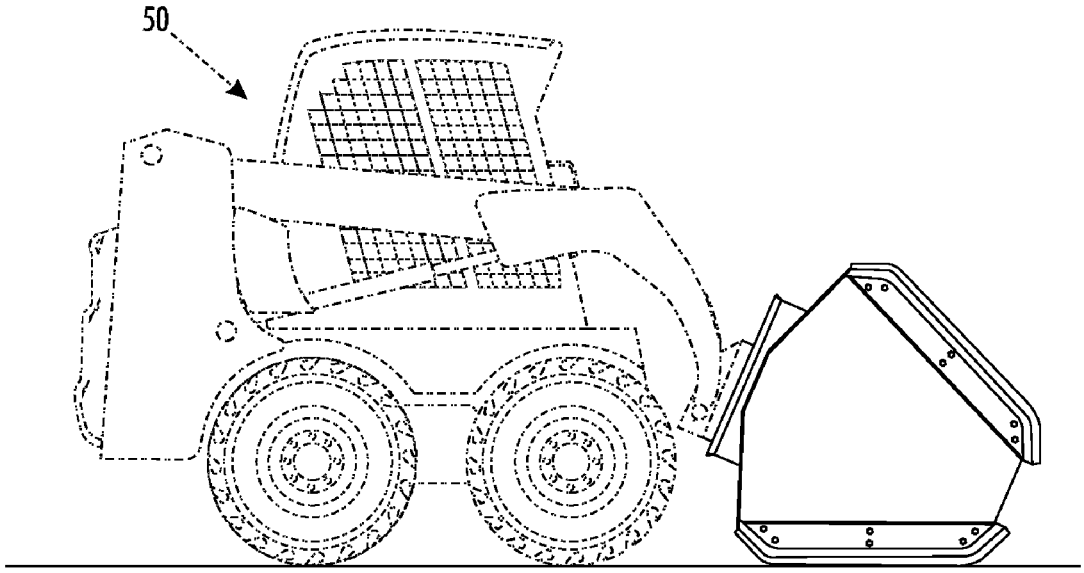
FIGS. 5A-5H illustrate various features and aspects of a switchblade, reversible coupling, pusher in accordance with an alternative embodiment, where FIGS. 5A-5H particularly illustrate steps of using the reversible coupling feature with a skidsteer type vehicle.
Figure 5B:
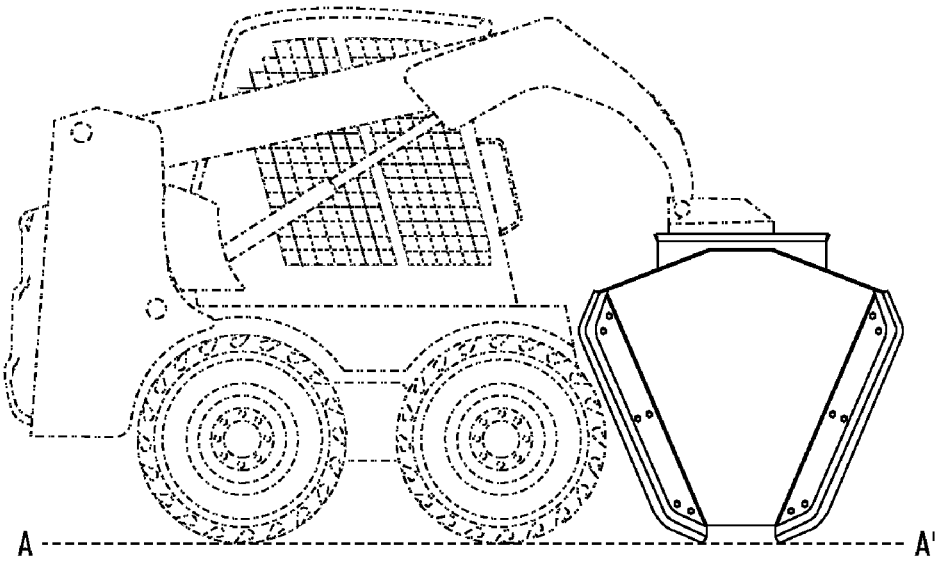
Figure 5C:
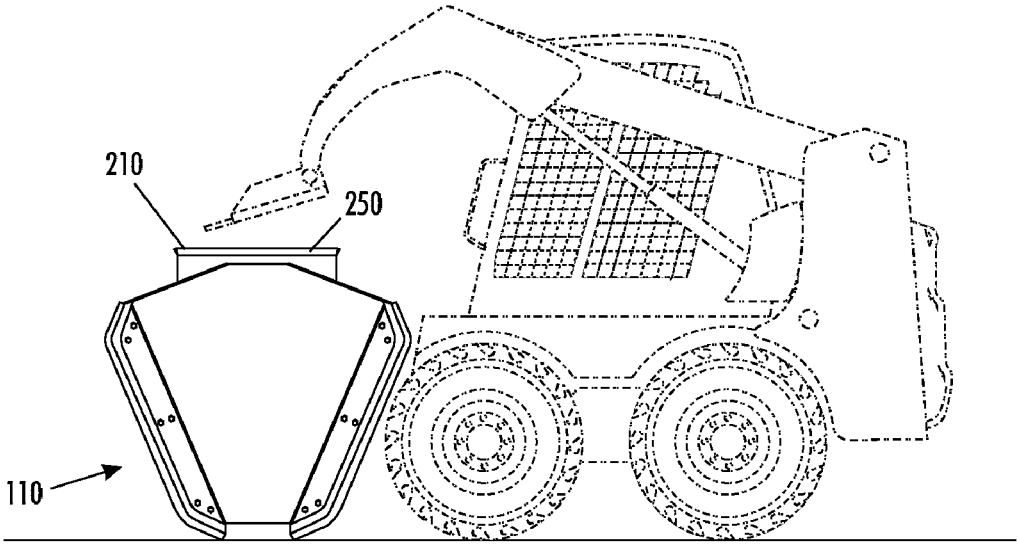
Figure 5D:
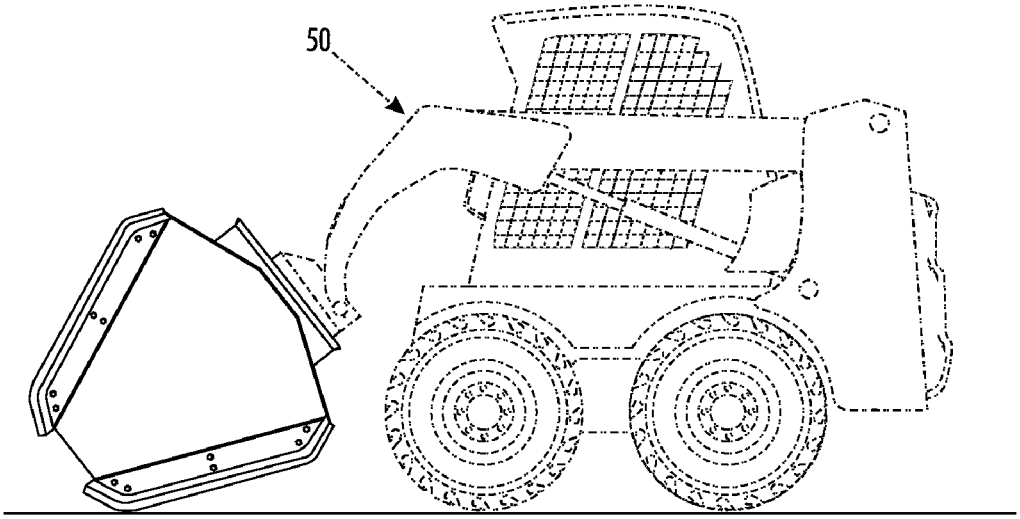
Figure 11A:
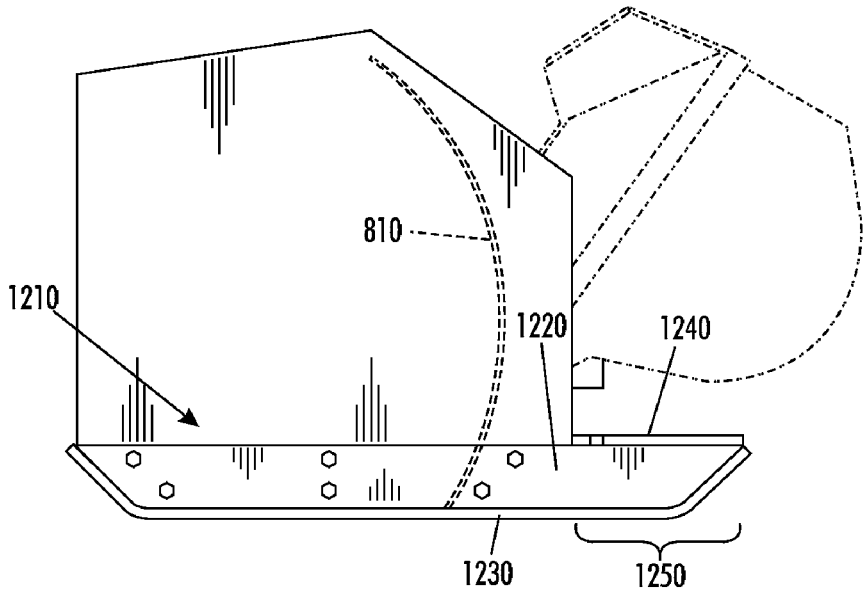
FIGS. 11A and 11B are illustrative side views of alternative embodiments of a snow pushing apparatus employing an extended wear shoe.
Figure 11B:
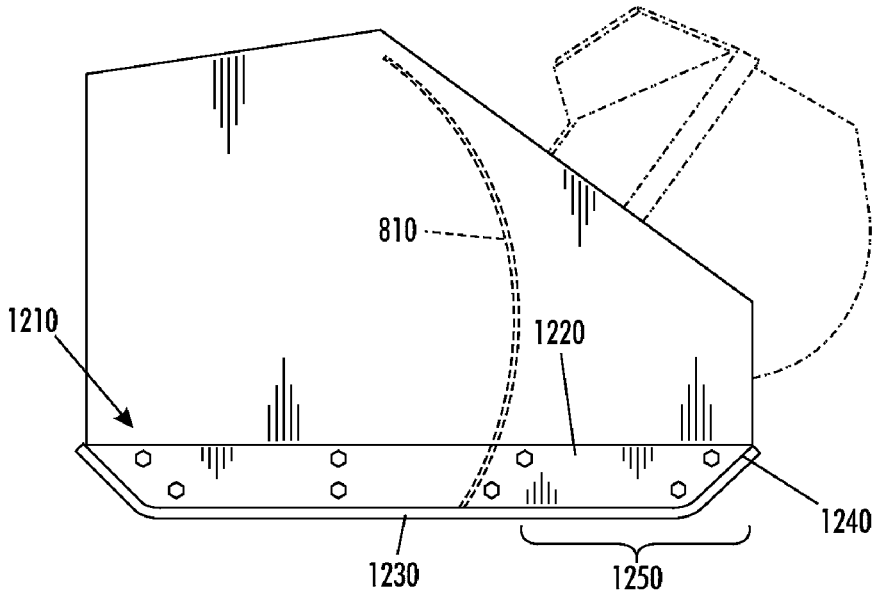

As is also shown in the figures, the pusher apparatus 110 further includes a pair of longitudinal wear shoes 190 along at least two edges of the side plate 170. The wear shoes may be removable, as depicted, or may be permanently attached or mounted to the side plate. The wear shoes may also be extended as depicted, for example, in FIGS. 11A, B described below. The wear shoes 190 comprise inclined front and rear ramp surfaces 192 for sliding contact on the surface. In one embodiment, the front ends of wear shoes 190 and/or the side plates 170, in conjunction, provide points or define a surface (along lines A-A') that enables the apparatus to temporarily stand in an upright position, such as depicted in the embodiment of FIGS. 5B and 5C, in order to permit a vehicle to change the direction in which the apparatus is oriented for pushing—thereby changing from a first operating position where the first scraping edge is adjacent to the surface being cleaned to a second operating position whereby the second scraping edge is adjacent to the surface to be cleaned.

Considering FIGS. 1-3 and 5A-5H, it will be apparent that the nature of the vehicle (skidsteer, backhoe or loader) is accommodated by one of several reversible couplers 210, or similar reversible means for attaching the apparatus to a vehicle. The reversible coupler further enables the pushing vehicle 50 to be suitably attached, from either of two opposite directions. Where the vehicle 50 is a skidsteer-type or similar loader vehicle, the reversible coupler 210 includes a quick-coupling connection for both directions.

Figure 5E:
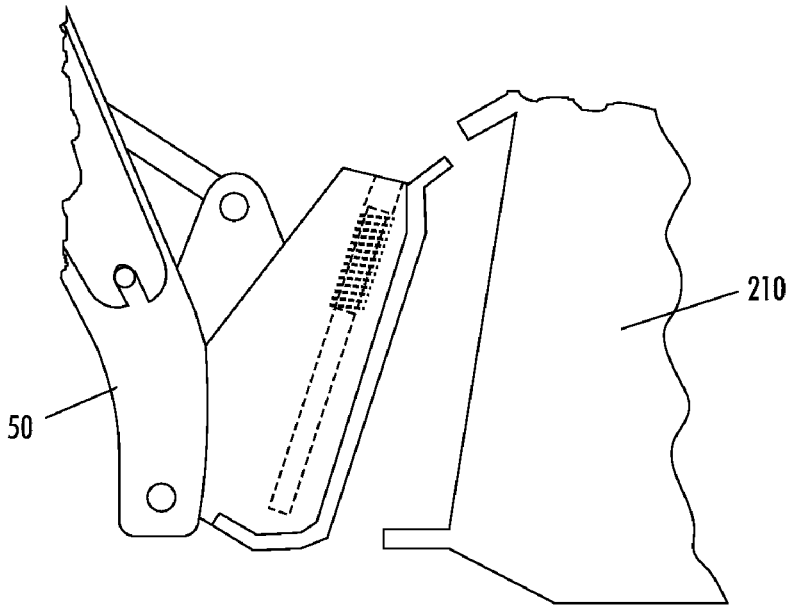
Figure 5F:
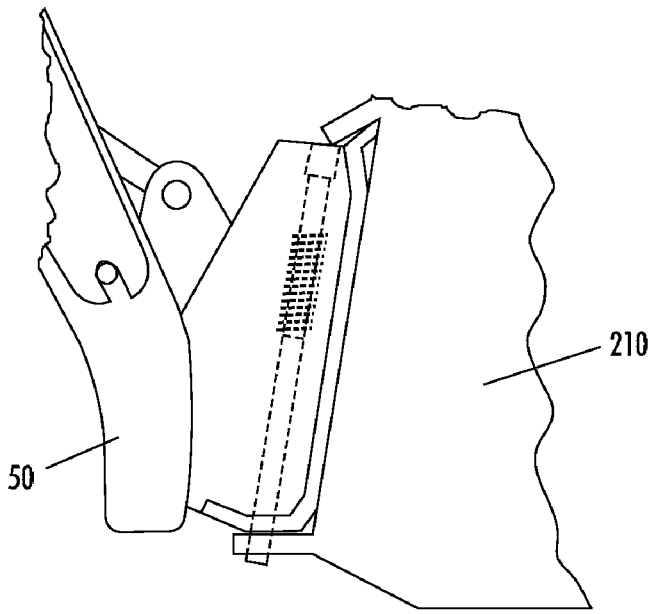
Figure 5G:
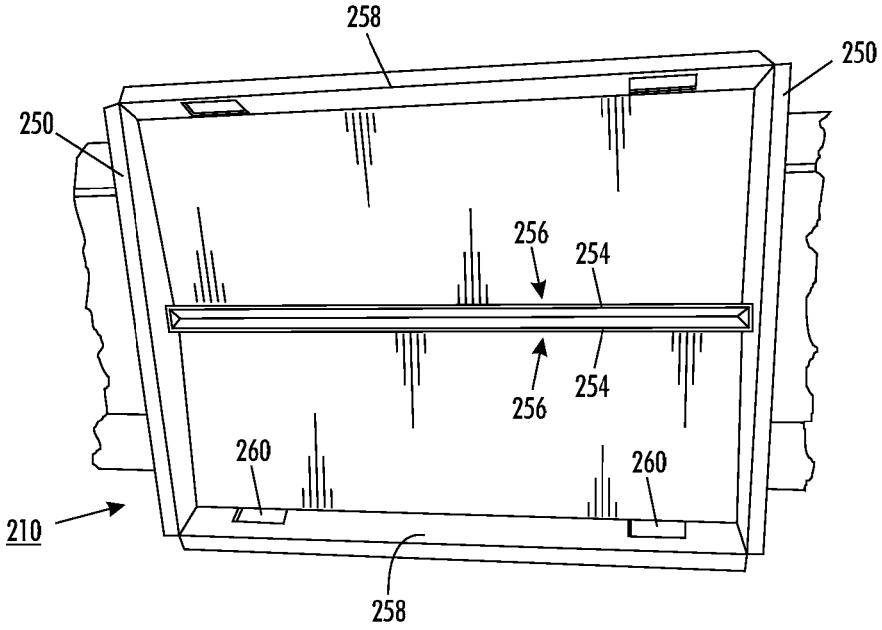
Figure 5H:
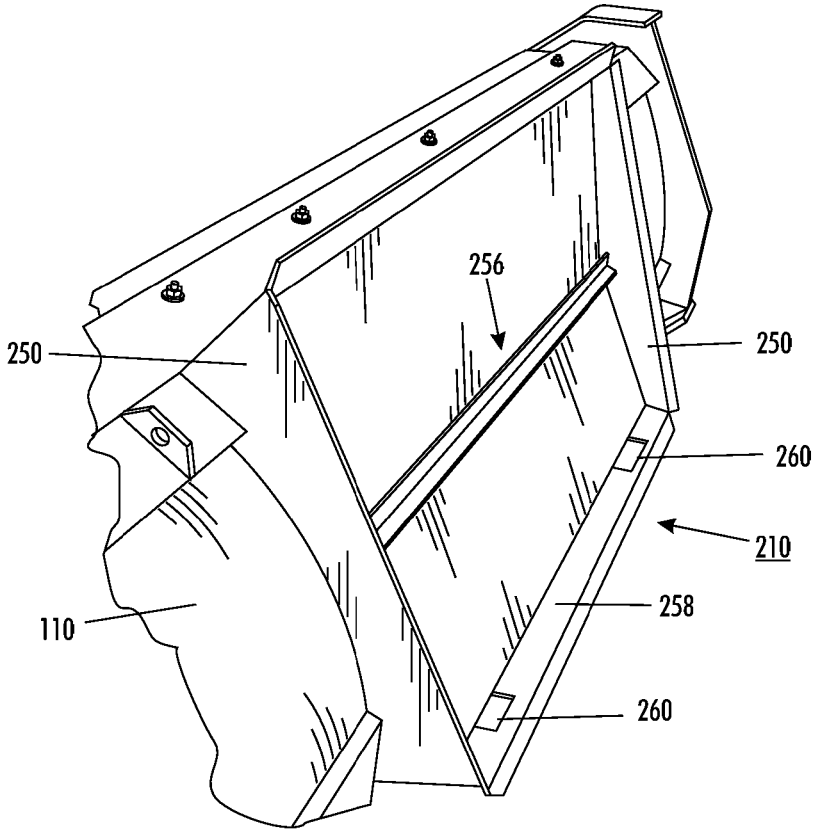

The reversible coupler 210 referred to above may be used with a reversible (Switchblade) pusher or with other reversible implements such as those known for use with skidsteer type vehicles. In one embodiment, reversible coupler 210 includes a first coupler assembly 220, suitable for attachment to a vehicle (loader, skidsteer, etc.) in a first orientation, and a second coupler assembly 230 suitable for attachment to the vehicle in second first orientation. It will be appreciated that the first and second coupler assemblies are essentially mirror image replications of one another and may be contained within a common frame or assembly as depicted in FIGS. 5G and 5H, for example. It is further contemplated that a reversible pusher may have a plurality of non-mirrored couplers on the rear thereof, where one coupler is suitable for receiving a bucket of a loader or backhoe whereas another coupler is suitable for use with a skidsteer-type vehicle, thereby permitting a single pusher to be used with a plurality of vehicle types.

In the embodiment of FIG. 1, each coupler assembly 220, 230 includes two rows of parallel posts mounted on the rear of the pusher, the two rows of parallel posts form a slot 224 for receiving the edge of a bucket on the vehicle (not shown in FIG. 1). Referring to FIGS. 5C, F and G, for example, each reversible coupler assembly 210 is mounted on the rear of the pusher 110 and includes a pair of generally parallel side rails 250, and opposed top members (e.g., downward facing flange) 254, generally spanning between the side rails and providing a downward-facing pocket 256 on the rear of the pusher, the pocket receiving an upper edge or the like of a skidsteer attachment frame, and an angled foot or lower attachment member 258 on opposite ends, also spanning between the side rails, and suitable for receiving a lower wedge, pin or the like of the skidsteer attachment device. FIGS. 5E and 5F are illustrative examples of one method by which the skidsteer attachment device may be connected; first the attachment device of vehicle 50 is inserted into the pocket 256 and then, upon full connection of the attachment device with the coupler, the locking wedge or pin is inserted. It will be appreciated that various alternative means may be employed to interface with the reversible coupler 210.

As an example of one possible configuration for the coupler assembly, FIGS. 5E-5H are referred to in order to illustrate the manner in which a skidsteer (e.g., Bobcat™) or similar vehicle is attached to the coupler. It will be appreciated that the coupler mechanism is duplicated in a mirrored configuration (FIGS. 5F, G) to provide the reversible coupling referred to. It will also be appreciated that the coupler foot 258 may further include recesses, apertures 260 or similar features for receiving a locking wedge/detent or similar component or mechanism on the vehicle attachment frame—thereby providing positive attachment to the pusher. Alternatively, the pusher may be connected to the vehicle using well know means such as, hooks, clevises, chains and the like as is well known for connecting pushers to vehicles.

The coupler depicted in FIG. 5C is mounted on the rear of a pusher 110 and employs a common set of side rails such that both of the opposed coupling mechanisms form a single assembly suitable for coupling with a vehicle from opposite or reversible orientations.

Further referring to FIGS. 5A-5D, the sequence of figures illustrates a method for using a reversible pushing apparatus as described herein. The method includes connecting a vehicle 50 to the pusher in a first orientation (FIG. 5A), moving the pusher with a first edge adjacent the ground surface (FIG. 5A), standing the pusher on its "nose" (for example along the plane defined by line A-A') as shown in FIG. 5B, disconnecting the vehicle from the pusher while in the "nose-down" position (FIG. 5C) and reconnecting the vehicle to the pusher in a second orientation (FIG. 5D), in order to subsequently move the pusher with a second edge adjacent the ground surface.

In an alternative method it is simply possible to use the vehicle 50 to roll or flip the pusher from one orientation to the other, thereby avoiding the need to temporarily place the pusher into a nose-down position. As will be appreciated, the vehicle should be disengaged from its respective coupler before flipping so as to enable the pusher to switch or reverse to the opposite orientation.

Figure 6:
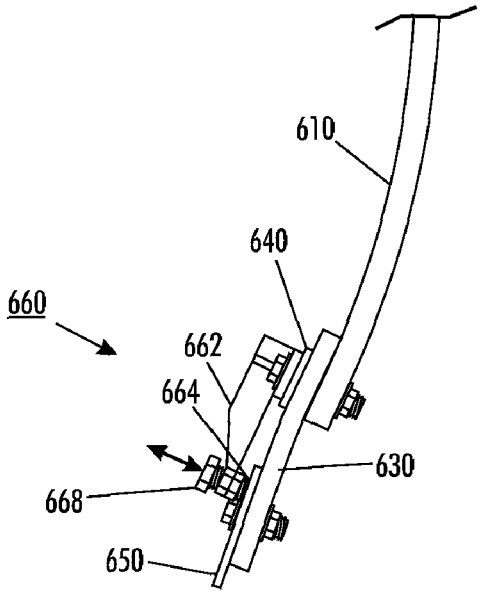
FIGS. 6-7 illustrate various embodiments of a flexible trip edge in accordance with another aspect of the invention.
Figure 7:
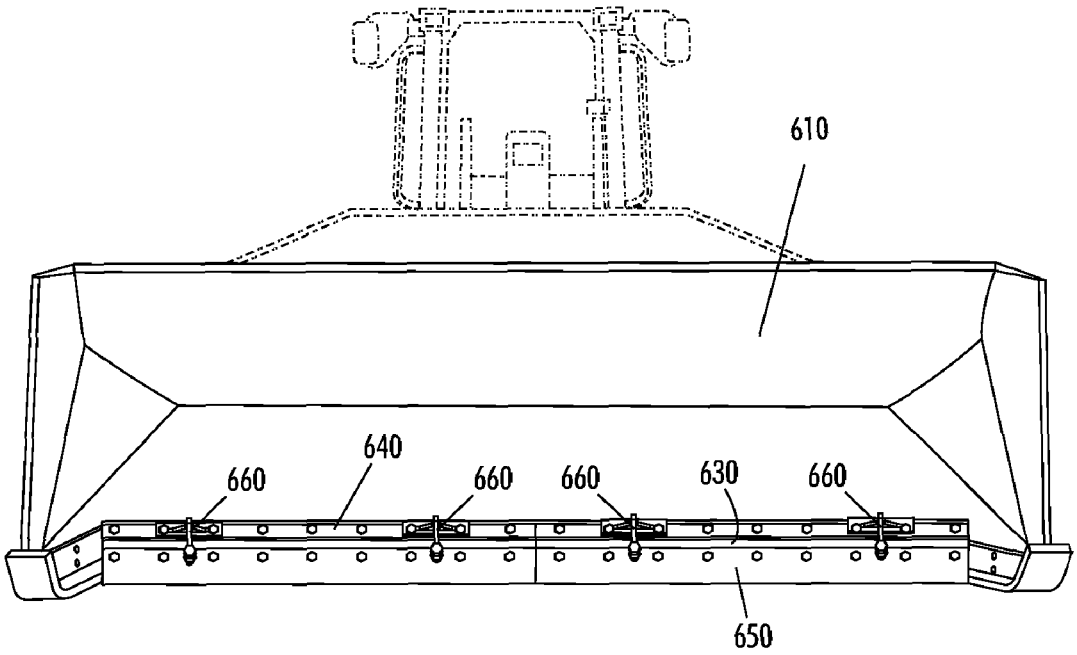

Referring next to FIGS. 6-7 there is depicted one embodiment of an improved scraping edge for use with the pusher described above, or with other conventional snow pusher designs, including those manufactured by Pro-Tech® and other manufacturers. In general, the improved scraping edge is attached to the central blade or moldboard along a longitudinal edge, and the scraping edge includes a rigid component and means for assuring that said rigid component yields upon coming in contact with an immovable object. In one embodiment, depicted in FIGS. 6-7, the yielding means may include a flexible base member whereas in an alternative embodiment, depicted in FIGS. 8-10, the yielding means may include a sacrificial fastener as well as similar components that flex or yield so that the cutting edge does not damage immovable objects it comes in contact with them.

The improved cutting edge of FIGS. 6-7 is designed for attachment along a longitudinal edge of a pusher moldboard 610, and in a first embodiment comprises a flexible base 630, removably attached to the moldboard, along a top portion of the base. In one embodiment, the attachment means includes a metal hold-down member 640 applied on the face of the flexible base 630, wherein the flexible base is sandwiched between the hold-down member 640 and the moldboard 610. Removably attached to the flexible base 630, along a bottom portion thereof is a rigid cutting edge 650, preferably made of steel and alloys thereof that exhibit high hardness and good wear resistance. The use of the flexible base as the means by which the rigid cutting edge is attached to the moldboard flexible permits flexing of the base and allows the cutting edge to bypass an immovable object that it contacts while the pusher moves and then return to a nominal operating position.

The flexible scraping edge base 630 may be made of a polymer (e.g., polyurethane), rubber or similar material, and is approximately 1.5 (1.0-2.0) inches thick. Such materials are available from CUE, Inc. (e.g., Compound No. PO-650) and exhibit approximately the following characteristics: shore durometer (ASTM D2240-64T) of 84 A; a compression set of 45% max.; a tensile strength (ASTM D412-61T) of 6000 psi; tensile modulus (ASTM D412-61T)@50% elongation of 500 psi; tear strength Trollsera (ASTM D1938)=250, Die C (ASTM D624)=470 and split tear (ASTM D470)=140; compression deflection (ASTM D575-46 Method A)@5%=300 psi; and abrasion resistance for Tabor (ASTM D3489-85(90)) of 15% rubber standard or NBS ASTM D1630-83=250.

In an alternative embodiment, the flexible scraping edge may further include a tensioner 660 to bias the flexible base into a partially flexed position. The use of a biasing means to pre-flex the base 630 assures that the base flexes rearward as the cutting edge 650 comes into contact with an immovable object such as a manhole, water-valve cap, curb, raised concrete or asphalt patch or similar objects. As will be appreciated, alternative biasing means including springs, pre-deformation of the base, tabs or stops along the side plates, etc. may be employed to assure that the polymer base 630 flexes rearward when the edge 650 contacts an immovable object. Absent a tensioner or other means for biasing or preflexing the base, the cutting edge may chatter and skip when contacting or moving over surfaces that are uneven yet generally free of immovable obstructions.

As further depicted in FIGS. 6 and 7, the tensioner is removably attached to the moldboard using the same bolts employed for the metal hold-down member 640. The tensioner includes an arm 662 that extends downward from where it is attached to the moldboard, and at the end of the arm there is a contact point 664 that applies a force or biasing contact to the metal cutting edge 650, and the flexible base 630 is biased into the partially flexed (rearward) position as shown in the side view of FIG. 6. It is also intended that the contact force or amount of bias applied to the cutting edge 650 is adjustable by way of bias adjusting bolt 668, a threaded bolt at the end of the tensioner arm that establishes the contact point with the cutting edge in the embodiment depicted.

Those knowledgeable in the design of material pushers will appreciate that in an alternative embodiment a material pusher incorporating the improved cutting edge described above, may further include vertically extended or adjustable side plates and/or wear shoes, to provide increased or adjustable clearance between the bottom or the steel cutting edge 650 and the ground surface, thereby providing a region for the installation of the flexible cutting edge—and to provide a sufficient gap below the moldboard in which the edge can flex un an unconstrained fashion.

Turning next to FIGS. 8-11, there is disclosed yet another embodiment of the breakaway cutting edge for use on a longitudinal edge of a material pusher or similar plow or pushing apparatus. In the design, the breakaway edge provides a cutting surface adequate to remove hard-packed snow or ice from a surface, yet prevents damage to immovable objects (e.g., manholes, sewercovers, curbs, etc.) that come into contact with the edge. The edge design assures that it becomes detached or "breaks away" from the moldboard upon striking such objects with sufficient force.

Figure 10:
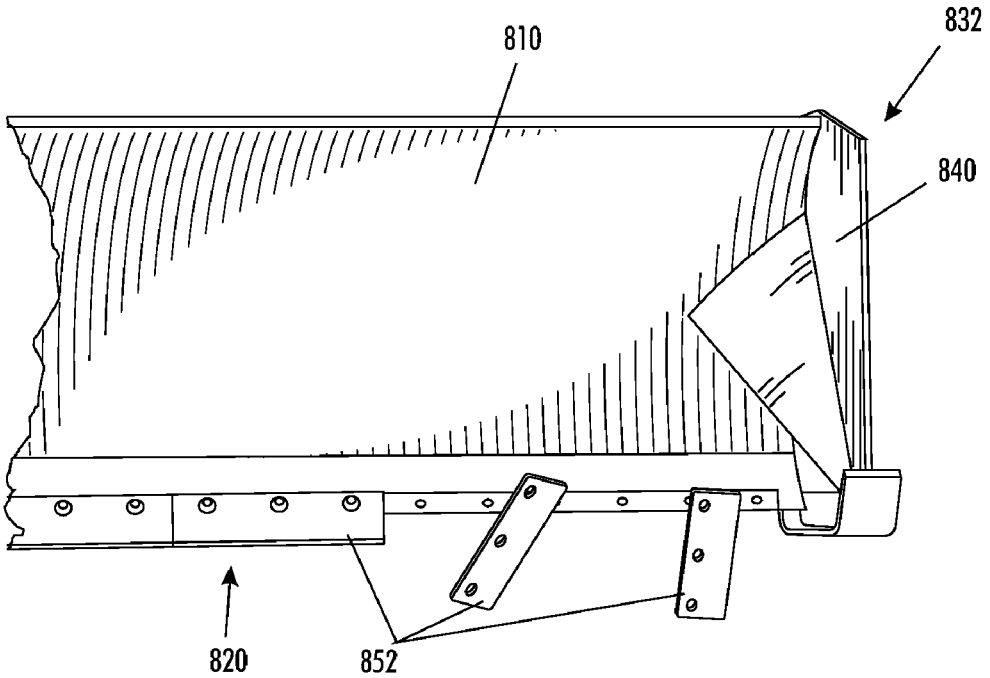

In one embodiment depicted in FIG. 10, for example, the pusher comprises an upstanding central blade 810 having a lower longitudinal edge 820 and left (832) and right ends (not shown). A vertical side plate 840 extends forward generally at a right angle from each end of the central blade. The breakaway cutting edge 850, comprises a plurality of sections 852, attached to the central blade 810 along the longitudinal edge. At least one of the sections (852) may be dislodged from its normal operating position in response to the application of sufficient force resulting from contact with an immovable object, thereby preventing damage to the object.

Figure 8:
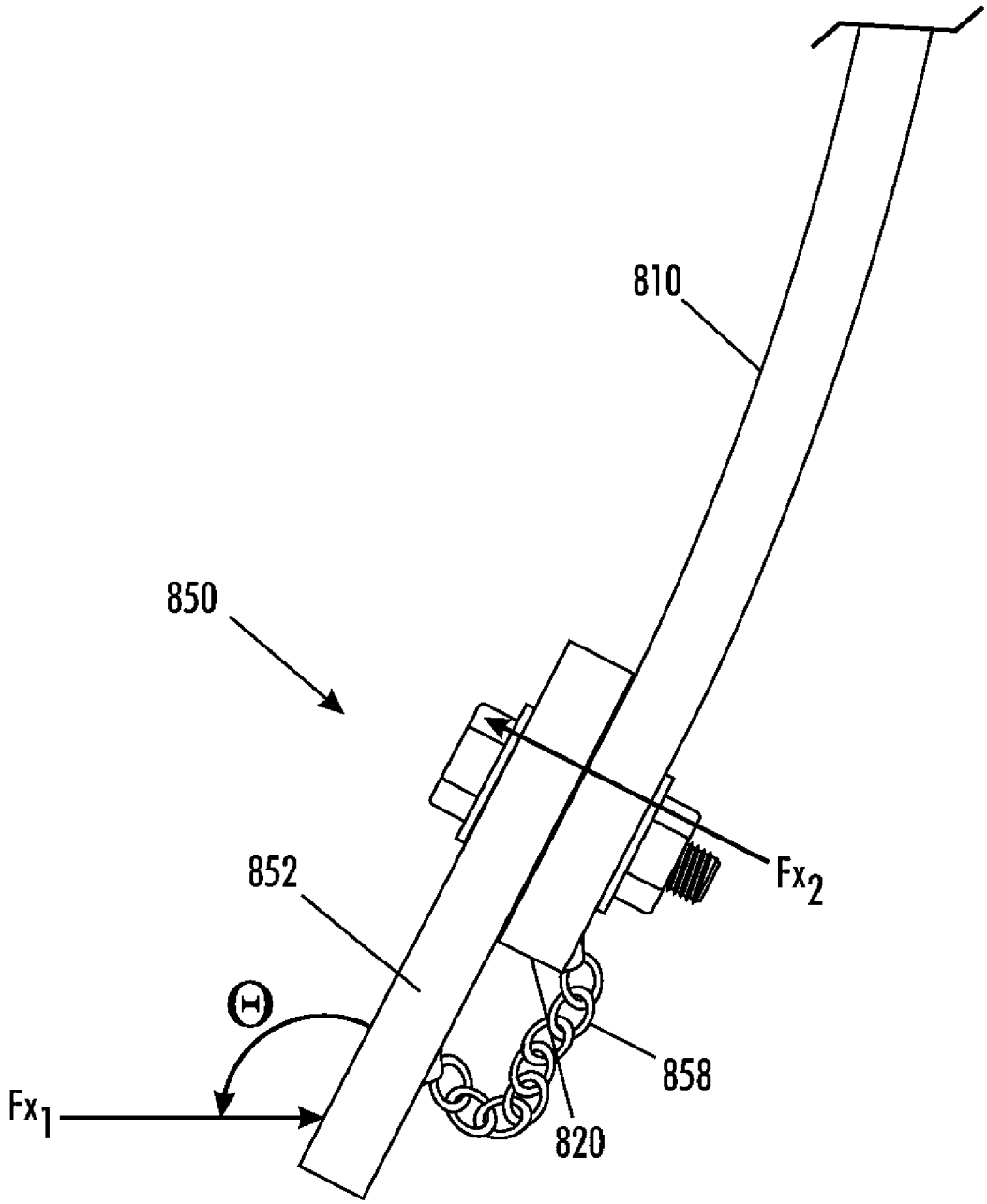
FIGS. 8-10 illustrate various embodiments of a breakaway edge in accordance with another aspect of the invention.
Figure 9:
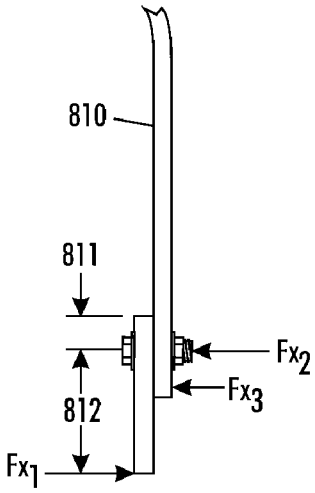

As depicted in FIGS. 8 and 9, an applied force $Fx_1$ is applied to the cutting edge by an immovable object when the pusher is being moved forward along the ground. The force is translated to resulting forces (e.g., $Fx_2$) and relative to opposing force ($Fx_3$) that place the fastener holding the edge 852 to the moldboard 810, in tension and/or shear. As will be further appreciated, the force applied to the fastener is a function of not only $Fx_1$, but also of the relative dimensions of the edge in relation to the moldboard's longitudinal edge, for example, dimensions 811 and 812. For example, force $Fx_1$ translates to a significantly "magnified" force $Fx_2$ as a result of the leverage provided by a wide edge (e.g., dimension 811). As depicted, for example, in FIG. 8, the forces applied to the fasteners holding edge 852 to moldboard 810 are also a function of the angle ($\theta$) of the edge, which results in the addition of a shear stress applied to the fastener as well as a tensile stress.

Preferably, the longitudinal edge 820 of the central blade 810 is made of a material of sufficient strength, or is reinforced, to resist damage when the breakaway edge strikes an object. Moreover, the cutting edge sections 852 are made from or formed of steel or similar rigid and/or hardened materials, and are attached to the longitudinal edge using attachment hardware or fasteners (e.g., bolts with nuts as depicted in FIGS. 9 and 10) that offer less resistance to the applied stress (shear and/or tensile forces are present) than the cutting edge sections 852, so as to result in the failure of the hardware/fasteners before damage to the object or the pushing apparatus. More specifically, in one embodiment, the edge sections are mounted to the central blade using bolts having a yield strength of less than about 36,000 psi and a tensile strength of less than about 74,000 psi (equivalent of Grade 2 or less). It will be appreciated that SAE-J429 Grade 1 or 2 (also A307 Grades A, B), may be used to assure that the failure of the bolts, by shear or other means, will occur before damage to the pusher components or the immovable object. It will also be appreciated that depending upon the particular application, the dimensions of the components, and/or sensitivity to damage, alternative fasteners sizes, steel alloys/grades, materials and or hardware components may be employed (e.g., aluminum hardware, shear pins, etc.) Although the angle $\theta$ is illustrated at approximately 12-degrees from normal, the embodiment depicted in FIG. 9 is believed best operated over a range of angles from about 5-degrees to about 20-degrees from normal, although use over a range of about 0-degrees to about 30-degrees from normal and higher is possible.

As generally depicted in FIG. 9, the present invention further contemplates the use of a safety attachment mechanism 858 connecting the cutting edge sections 852 to the central blade or moldboard 810 so that in the event that the section is completely dislodged (i.e., all fasteners broken), the section will remain attached to the central blade for later reattachment. Such a mechanism may include a loop or hook welded to the back of the cutting edge and attached by chain, cable, clevis or the like to a similar loop or hook on the rear of the central blade.

Turning now to FIGS. 12A and 12B, there are depicted examples of extended wear shoes for use with a material pusher. The purpose of the extended shoe is to provide a larger surface on which the pusher rides, with the surface extending rearward from the coupling point, thereby making it easier for a vehicle operator to place the pusher in an orientation where the wear shoes are parallel to the ground or surface on which it is being used. Such a feature significantly decreases the likelihood that a pusher will be operated with only the front or rear edge contacting the surface, and thereby quickly wearing out that portion of the shoe. The improved, extended wear shoe 1210 includes a web 1220 for attachment to a side plate of a pusher, and a generally horizontal lower surface 1230 for sliding contact with the ground, the lower surface transitioning to front and rear ramped surfaces on either end thereof, and a cap, 1240 permanently attached to the exposed or extended portion of web 1220 and the upper end of the rear ramped surface. In other words, the cap covers and reinforces the web over at least part of the region 1250 where the shoe extends beyond the rear of the moldboard 810, and as depicted in FIG. 12A that portion beyond the rear edge of the side plate.

As seen in FIGS. 12A-12B, the wear shoe extends a distance (region 1250) of at least about 10 to about 25% of the side plate length beyond the rear of the moldboard 810, and as mentioned above beyond the coupling contact point between the vehicle and the pusher. Thus, the pusher has a removable wear shoe 1210 attached along a bottom edge of each vertical side plate, where the removable wear shoe extends from a position generally adjacent a front edge of the vertical side plate to a position well beyond the rear of the moldboard to assure that the majority of a bottom surface of the wear shoe remains in contact with the ground surface on which the pusher is used.

The present disclosure contemplates additional improvements to the wear shoe, that include at least a wear shoe lower horizontal surface 1230 made from a steel (e.g., HARDOX 500 (Super Duty) from SSAB Oxelsund AB with 0.26% Cr, 0.49% Si, 1.15% Mn, 0.010% P, 0.002 S, 0.070 Cr, 0.05 Ni, 0.009 Mo and 0.002 B) having a hardness of at least about 300 and more preferably about Brinnell. In such embodiments, a heavy duty shoe having improved wear performance may be fabricated using HARDOX 400 (Heavy Duty) or HARDOX 500 (Super Duty). HARDOX wear plate has a hardness of at least 300 and approximately 400 HB. It combines high wear resistance with toughness and good weldability. HARDOX is manufactured by SSAB Oxelosund AB. Use of the 400 and 500 grades is believed adequate, having a Brinnell hardness from about 300-550, to significantly reduce the wear of the shoes during normal pusher use. It will be further understood that the thickness of the lower horizontal surface of the various wear shoes may also be modified to provide longer shoe life.

It will be appreciated that various of the afore-described improvements and modifications may be applied or adapted to operate in conjunction with or on other types of pushers and material moving or scraping apparatus, including but not limited to, fold-out pushers and other types of snow plows and blades. It will be further appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A reversible material pushing apparatus, comprising:

an upstanding central blade including a first longitudinal edge and a second longitudinal edge along an opposite side of said blade, and left and right ends;

a vertical side plate attached to and extending forward at a generally perpendicular angle from each of the ends of the central blade;

a first cutting edge attached to the central blade along the first longitudinal edge to operate when the apparatus is in a first orientation;

a second cutting edge attached to the central blade along the second longitudinal edge to operate when the apparatus is in a second orientation; and a reversible coupling mechanism permanently affixed to the central blade, said reversible coupling mechanism including first and second coupler assemblies, said first coupler assembly having a first orientation for attaching the apparatus to a vehicle to move the apparatus in the first orientation for use of the first longitudinal edge of said blade, said second coupler assembly having a second orientation for attaching the apparatus to a vehicle to move the apparatus in the second, opposite orientation for use of the second longitudinal edge of said blade, said first and second coupler assemblies also being separated from one another in a vertical direction to respectively provide separate first and second locations for attachment of the apparatus, wherein said second coupler assembly is not attached to the vehicle when the implement is in the first orientation and the first coupler assembly is not attached to the vehicle when the implement is in the second orientation.

2. The apparatus of claim 1, further comprising a pair of wear shoes along at least two edges of said side plate on each end of the central blade.

3. The apparatus of claim 2, wherein the wear shoes and the side plates, in conjunction, define a plane on which the apparatus may temporarily stand to permit a vehicle to change from a first operating position where the first cutting edge is adjacent to a surface to a second operating position where the second cutting edge is adjacent to the surface.

4. The apparatus of claim 3 in which the wear shoes further comprise inclined front and rear ramp surfaces for sliding contact on the surface.

5. The apparatus of claim 1, wherein each of the first and second coupler assemblies further include a top pocket and a foot.

6. The apparatus of claim 1 wherein at least one of said first and second cutting edges includes a flexible edge that is removably fastened to and extends along a longitudinal edge of said central blade.

7. The apparatus of claim 1, wherein at least one of said first and second cutting edges is removably fastened to the central blade along one of the longitudinal edges.

8. The apparatus of claim 7, wherein at least one of said first and second cutting edges comprises a metal scraping edge.

9. The apparatus of claim 7, wherein the first cutting edge comprises a flexible edge and the second cutting edge comprises a metal scraping edge.

10. The apparatus of claim 1, wherein the first and second coupler assemblies are mirror images of one another.

11. A reversible coupler for use with a reversible implement, comprising:

a first coupler assembly attaching the implement to a vehicle in a first orientation relative to the implement at a first location on the implement; and a second coupler assembly attaching the implement to a vehicle in a second orientation relative to the implement at a second location on the implement, said second location separated from said first location, where said second coupler assembly is not attached to the vehicle when the implement is in the first orientation and the first coupler assembly is not attached to the vehicle when the implement is in the second orientation, where the reversible implement includes a pusher, and wherein each coupler assembly includes two rows of parallel posts mounted on the rear of the pusher, the two rows of parallel posts forming a slot for receiving the edge of a bucket attached to the vehicle.

12. A reversible coupler for use with a reversible implement including a pusher, comprising:

a first coupler assembly attaching the implement to a vehicle in a first orientation relative to the implement at a first location on the implement; and a second coupler assembly attaching the implement to a vehicle in a second orientation relative to the implement at a second location on the implement, said second location separated from said first location, wherein each of said first and second coupler assemblies attached to the rear of the pusher includes:

a pair of generally parallel side rails;

a top flange, generally spanning between the side rails and forming a downward-facing pocket on the rear of the pusher, the pocket receiving an upper edge of a vehicle attachment frame; and a foot, also spanning between the side rails, suitable for receiving a lower edge of the vehicle attachment frame.

13. The reversible coupler of claim 12, wherein the foot further includes at least one feature therein for receiving a locking mechanism of the vehicle.

14. A reversible coupler for use with a reversible implement, comprising:

a first coupler assembly attaching the implement to a vehicle in a first orientation relative to the implement at a first location on the implement; and a second coupler assembly attaching the implement to a vehicle in a second orientation relative to the implement at a second location on the implement, said second location separated from said first location, where said second coupler assembly is not attached to the vehicle when the implement is in the first orientation and the first coupler assembly is not attached to the vehicle when the implement is in the second orientation, where the reversible implement includes a pusher, and wherein each coupler assembly is mounted on the rear of the pusher and where a common set of side rails are used such that both coupler assemblies are combined into a single mechanism suitable for coupling with a vehicle from two, opposite orientations.

15. A method of using a reversible pusher, comprising:

connecting a vehicle to the pusher at a first location using only a first coupling assembly in a first orientation, said pusher having a first cutting edge adjacent a surface upon which the pusher rests in said first orientation;

using the pusher with the first cutting edge adjacent the surface;

disconnecting the pusher and the first coupling assembly from the vehicle;

reconnecting the vehicle to the pusher at a second location in a second orientation using only a second coupling assembly, said pusher having a second cutting edge adjacent the surface in said second orientation, wherein said second location is separated from said first location, such that the first coupling assembly does not overlap the second coupling assembly; and using the pusher with the second cutting edge adjacent the surface.

16. The method according to claim 15, wherein the first and second orientations are opposite one another.

* * * * *